US010377134B2

(12) United States Patent
Takabe et al.

(10) Patent No.: US 10,377,134 B2
(45) Date of Patent: Aug. 13, 2019

(54) MEMS DEVICE, LIQUID EJECTING HEAD, LIQUID EJECTING APPARATUS, AND MEMS DEVICE MANUFACTURING METHOD

(71) Applicant: SEIKO EPSON CORPORATION, Tokyo (JP)

(72) Inventors: Motoki Takabe, Shiojiri (JP); Eiju Hirai, Azumino (JP); Munehide Saimen, Suwa (JP); Yasuyuki Matsumoto, Azumino (JP); Shuichi Tanaka, Chino (JP); Tsuyoshi Yoda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/627,662

(22) Filed: Jun. 20, 2017

(65) Prior Publication Data

US 2017/0368826 A1 Dec. 28, 2017

(30) Foreign Application Priority Data

Jun. 27, 2016 (JP) ..... 2016-126306

(51) Int. Cl.
*B41J 2/14* (2006.01)
*B41J 2/16* (2006.01)

(52) U.S. Cl.
CPC ..... *B41J 2/14201* (2013.01); *B41J 2/14072* (2013.01); *B41J 2/1607* (2013.01); *B41J 2/14233* (2013.01); *B41J 2002/14491* (2013.01)

(58) Field of Classification Search
CPC ..... B41J 2/14201; B41J 2/04581; B41J 2/14072; B41J 2/1433; B41J 2002/14491
See application file for complete search history.

(56) References Cited

U.S. PATENT DOCUMENTS 6,387,734 B1 5/2002 Inaba et al.
2006/0268047 A1* 11/2006 Ota ..... B41J 2/14233 347/20
2016/0263887 A1* 9/2016 Tanaka ..... B41J 2/14233

FOREIGN PATENT DOCUMENTS

JP 2005-353633 A 12/2005
JP 2008-260150 A 10/2008
WO WO 2000/77843 12/2000

* cited by examiner

*Primary Examiner* — Geoffrey S Mruk
(74) *Attorney, Agent, or Firm* — Workman Nydegger

(57) ABSTRACT

A MEMS device includes a wire that is formed of a conductive portion embedded into a recess opened in a first face of a substrate and a bump electrode that is electrically connected to the wire. A total width, in a second direction intersecting a first direction along which the wire extends on the first face, of an opening of the recess in a connection region where the wire and the bump electrode are electrically connected to each other is narrower than a width, in the second direction, of an opening of the recess in a region outside the connection region.

18 Claims, 9 Drawing Sheets

MEMS DEVICE, LIQUID EJECTING HEAD, LIQUID EJECTING APPARATUS, AND MEMS DEVICE MANUFACTURING METHOD

CROSS-REFERENCE TO RELATED APPLICATIONS

The present application claims priority to Japanese Patent Application No. 2016-126306, filed Jun. 27, 2016, which is hereby incorporated by reference in its entirety.

BACKGROUND

1. Technical Field

The present invention relates to a MEMS device such as a liquid ejecting head, a liquid ejecting head, a liquid ejecting apparatus, and a MEMS device manufacturing method. In particular, the invention relates to a MEMS device, a liquid ejecting head, and a liquid ejecting apparatus that include wires formed of conductive portions embedded into recesses formed in a substrate, and a method of manufacturing such a MEMS device.

2. Related Art

Microelectromechanical systems (MEMS) devices including a driving element such as a piezoelectric element, an electronic circuit, or the like on a silicon substrate are applied to various liquid ejecting apparatuses, display devices, vibration sensors, and the like. For example, in a liquid ejecting apparatus, various liquids are ejected (discharged) from a liquid ejecting head that is one form of a MEMS device. In such MEMS devices, a configuration is adopted in which plural substrates used for electrical signals to drive a driving element or the like are electrically connected to each other. One such proposed configuration employs embedded wires that are formed by embedding conductive portions of copper (Cu) or the like, serving as wiring material, into groove-shaped recesses by a plating process, a sputtering process, or the like and then polishing away excess conductive portion that rises outside of the recess openings using, for example, chemical mechanical polishing (CMP) (for example, see JP-A-2005-353633).

However, in configurations in which the above embedded wires are formed on a silicon substrate and such plural embedded wires are provided to the substrate, it is difficult to have the excess portions that rise in a uniform thickness. Thus, when the embedded wire from which an excess portion rises the most is polished until it is even with the substrate surface, as the conductive portions, which are softer than the substrate material (silicon), are more easily removed, a phenomenon called dishing occurs in which the other embedded wires sink below the substrate surface toward the opposite side face. When such dishing occurs, a step arises between the substrate surface and the embedded wires, and therefore there is a risk of disconnections, increased resistance, or the like in wires stacked over the embedded wires, which may result in the MEMS device having diminished reliability.

SUMMARY

An advantage of some aspects of the invention is that a MEMS device, a liquid ejecting head, a liquid ejecting apparatus, and a MEMS device manufacturing method capable of suppressing dishing in embedded wires are provided.

A MEMS device according to an aspect of the invention includes a wire that is formed of a conductive portion embedded into a recess opened in a first face of a substrate and a bump electrode that is electrically connected to the wire. A total width, in a second direction intersecting a first direction along which the wire extends on the first face, of an opening of the recess in a connection region where the wire and the bump electrode are electrically connected to each other is narrower than a width, in the second direction, of an opening of the recess in a region outside the connection region.

According to the above configuration, since the total width of the opening of the recess in the connection region is narrower than the width of the opening of the recess in the region outside of the connection region, dishing in which the conductive portion filled into the recess sinks below the surface of the substrate is able to be suppressed. Accordingly, a step between the surface of the substrate and the conductive portion inside the opening of the recess can be suppressed, and thus disadvantages such as disconnections, increases in the resistance, and the like of wires stacked over the wires at the step can be reduced. Further, in the connection region, variation in the height (the position in the direction of stacking the substrates) of the wire becomes less likely to occur, which enables reduction of the load needed to establish electrical conduction when the bump electrode is pressed against the wire to make electrical connection therewith.

In the above configuration, it is preferable to adopt a configuration in which the wire includes a support portion that supports the bump electrode in the opening of the recess in the connection region.

According to this configuration, since the support portion supports the bump electrode and the support portion bears load when the wire and the bump electrode are connected, electrical conduction is more reliably ensured while reducing load during connection.

In the above configuration, it is preferable to adopt a configuration in which an edge of the opening of the recess in the connection region projects further in the second direction toward an opposing opening edge side than an edge of the opening in the region outside the connection region.

According to this configuration, since the width of the opening of the recess in the connection region is narrower than the width of the opening of the recess outside of the connection region, dishing in which the conductive portion in the recess sinks below the surface of the substrate is suppressed.

In the above configuration, it is preferable to adopt a configuration in which a total width, in the second direction, of the opening of the recess in the connection region is narrower than a total width, in the second direction, inside the recess in the connection region.

According to this configuration, by making the total width of the opening of the recess in a connection region narrower than the total width inside the recess in the connection region, the cross-sectional area of the wire can be increased. This enables an increase in electrical resistance due to narrowing the width of the opening of the recess in the connection region to be suppressed.

In the above configuration, it is preferable to adopt a configuration in which the bump electrode is formed of a resilient body composed of resin with a conductive layer formed on a surface of the resilient body.

According to this configuration, since the load needed to establish electrical conduction when the bump electrode is pressed against the wire to make electrical connection therewith can be reduced, disadvantages due to excessive load, such as the electrode layers of the bump electrodes disconnecting, the substrates breaking, or the like are suppressed.

In the above configuration, the substrate may electrically connect, through the wire, a driving circuit and a driving element driven by signals output from the driving circuit, and the electrical connection between the bump electrode and the connection region is a connection between the driving circuit and the substrate or a connection between the substrate and the driving element.

According to this configuration, the driving circuit and the driving element may be more reliably electrically connected, which enables the reliability of the MEMS device to be improved.

A liquid ejecting head according to an aspect of the invention includes one of the above MEMS devices.

A liquid ejecting apparatus according to an aspect of the invention includes the above liquid ejecting head.

According to the above configuration, a more reliable liquid ejecting head and liquid ejecting apparatus may be provided.

A method of manufacturing a MEMS device according to an aspect of the invention is a method of manufacturing a MEMS device including a wire that is formed of a conductive portion embedded into a recess opened in a first face of a substrate made from silicon and a bump electrode that is electrically connected to the wire. The method includes forming a cavity extending in a plate thickness direction from the first face side of the substrate at a position where the recess is intended to be formed on the substrate; forming the recess by anisotropically etching the cavity to expand the cavity in a direction intersecting the plate thickness direction; filling a conductive portion into the recess; and removing excess conductive portion outside of an opening of the recess by polishing.

According to the above manufacturing method, since a cavity extending in the thickness direction of the substrate is expanded in a direction intersecting the plate thickness direction by anisotropic etching, a recess may be formed such that a total width inside the recess is wider than a total width of the opening of the recess in the first face of the substrate. Accordingly, the cross-sectional area of the wire may be increased while narrowing the width of the opening of the recess, and thus an increase in electrical resistance due to narrowing the width of the opening of the recess is suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Explanation follows regarding embodiments of the invention, with reference to the accompanying drawings. The embodiments described below include various limitations as preferable specific examples of the invention. However, the scope of the invention is not limited thereby unless specifically indicated to be so in the following explanation. Moreover, in the following, explanation is given using examples of an ink jet recording head (hereinafter, recording head), which is one form of a MEMS device according to the invention, and is one form of a liquid ejection head; and an ink jet printer (hereinafter, printer), which is one form of a liquid ejecting apparatus equipped with such a recording head.

Figure 1:
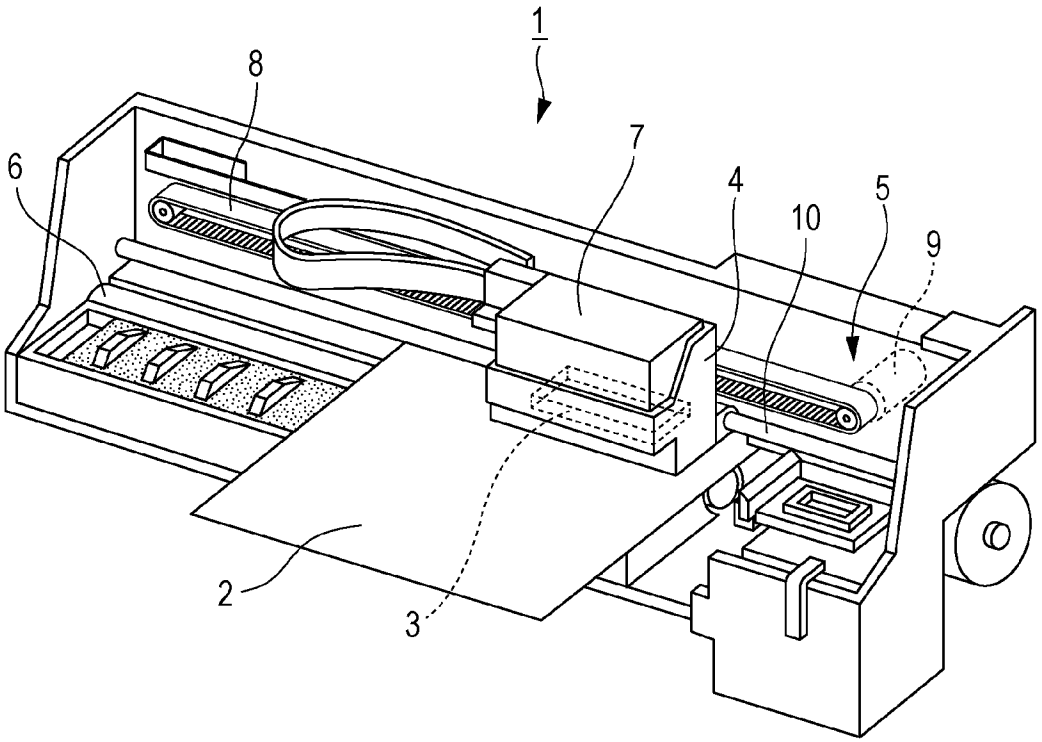
FIG. 1 is a perspective view illustrating configuration of a liquid ejecting apparatus (printer).

Configuration of a printer 1 is explained with reference to FIG. 1. Printer 1 is an apparatus that ejects ink (one type of liquid) onto the surface of a recording medium 2 such as recording paper to record images or the like. The printer 1 includes a recording head 3, a carriage 4 that is equipped with the recording head 3, a carriage moving mechanism 5 that moves the carriage 4 along a primary scanning direction, a transport mechanism 6 that moves the recording medium 2 along a secondary scanning direction, and the like. The ink is stored in an ink cartridge 7 that serves as a liquid supply source. The ink cartridge 7 is installed to the carriage 4 so as to supply ink stored therein to the recording head 3. Note that configuration may be adopted in which the ink cartridge is disposed on a main body side of the printer, and ink is supplied from the ink cartridge to the recording head through ink supply tubing.

The carriage moving mechanism 5 includes a timing belt 8. The timing belt 8 is driven by a pulse motor 9 such as a DC motor. Accordingly, when the pulse motor 9 is actuated, the carriage 4 is guided along a guide rod 10 spanning across the printer 1, and reciprocates along the primary scanning direction (a width direction of the recording medium 2). The position of the carriage 4 in the primary scanning direction is detected by a linear encoder (not illustrated in the drawings), which is one type of position information detector, and obtained by a controller of the printer 1.

Figure 2:
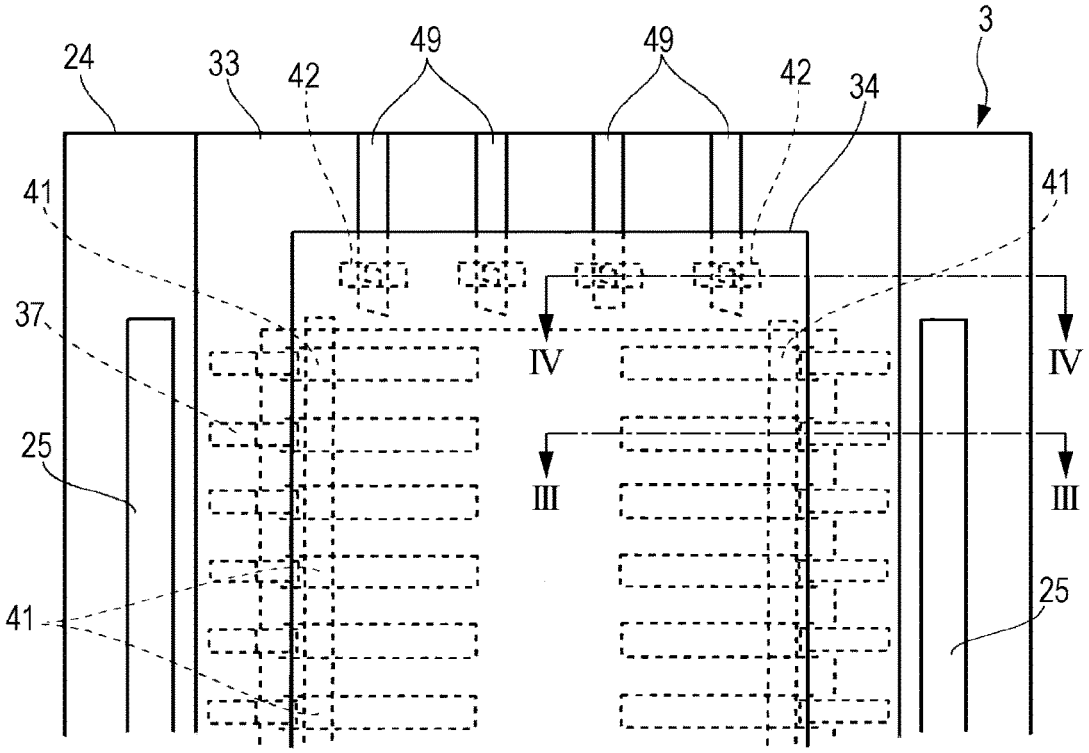
FIG. 2 is a plan view illustrating configuration of a MEMS device (recording head).
Figure 3:
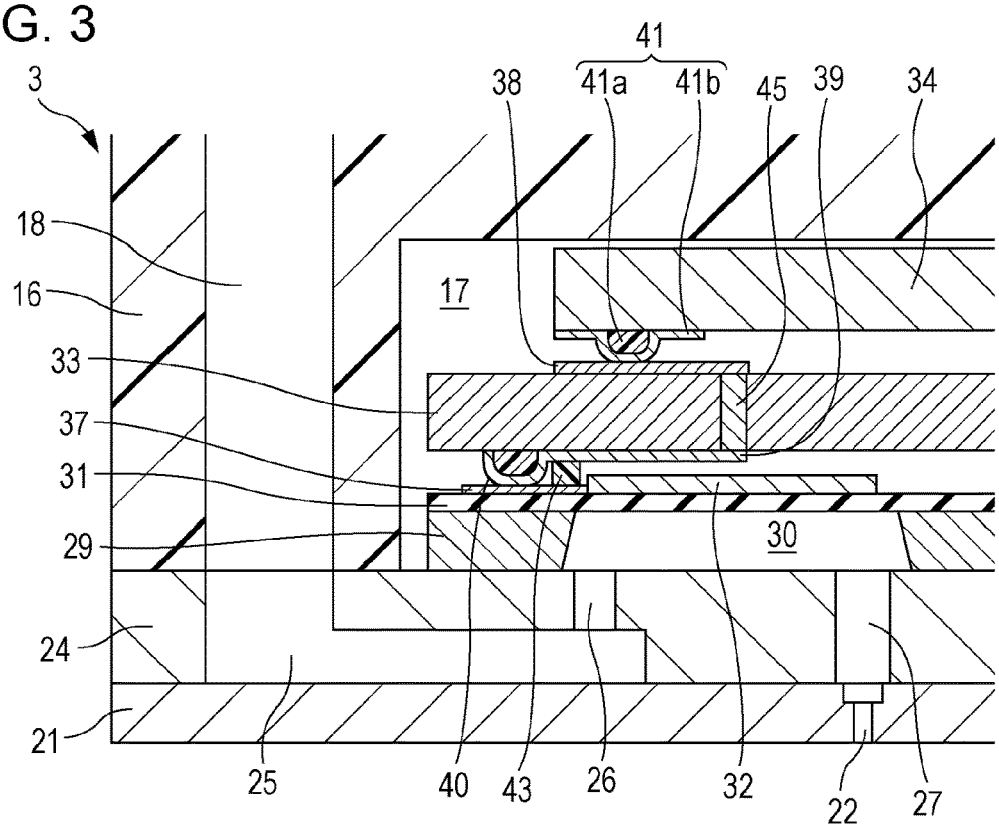
FIG. 3 is a cross-section taken along line III-III in FIG. 2.
Figure 4:
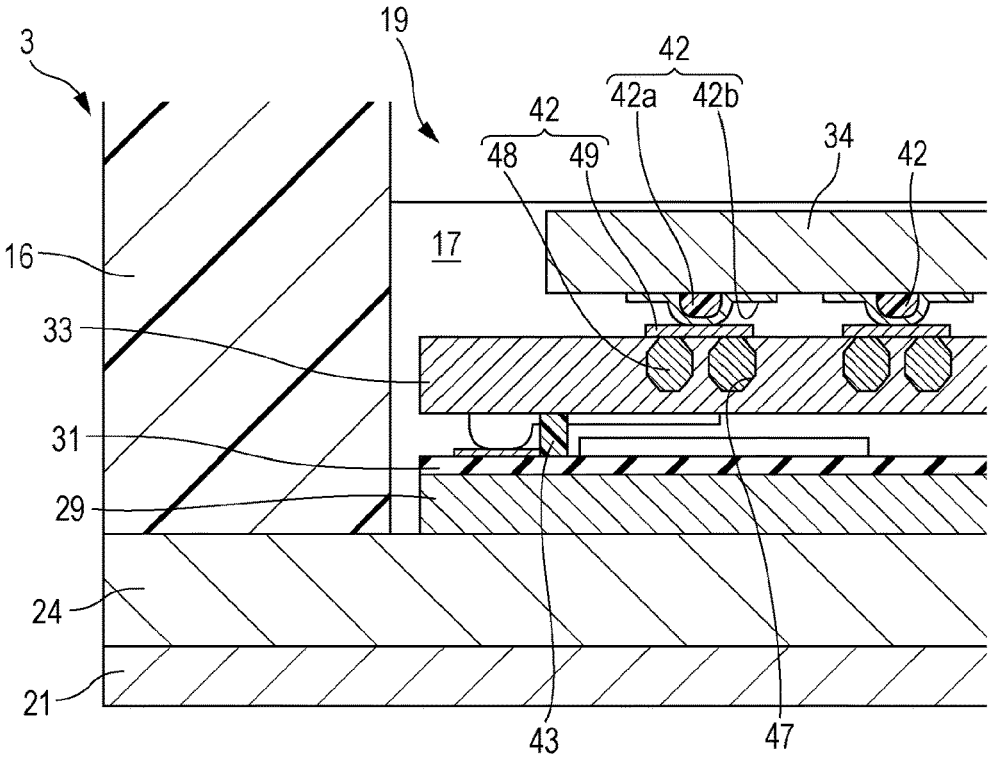
FIG. 4 is a cross-section taken along line IV-IV in FIG. 2.

Next, explanation is given regarding the recording head 3. FIG. 2 is a plan view illustrating configuration of the recording head 3. FIG. 3 is a cross-section taken along line III-III in FIG. 2. FIG. 4 is a cross-section taken along line IV-IV in FIG. 2. Note that illustration of a head case 16 is omitted from FIG. 2.

Plural substrates and the like are stacked and attached to the head case 16 to configure the recording head 3 of the present embodiment. The substrates are stacked in the order of a nozzle plate 21, a communication substrate 24, and a pressure chamber formation substrate 29, and bonded to each other by adhesive or the like so as to form a single unit. A diaphragm 31, piezoelectric elements 32 (one type of driving element of the invention), an interposing substrate 33 (one type of substrate or wiring substrate of the invention), and a driving IC 34 (one type of driving circuit of the invention) are stacked on a face on the opposite side of the pressure chamber formation substrate 29 to the communication substrate 24 side. Note that for convenience, the stacking direction of the various members is described as the up-down direction.

The head case 16 is a box shaped member made from synthetic resin, and a liquid entry path 18 that supplies ink to a common liquid chamber 25, described below, is formed inside the head case 16. The liquid entry path 18, together with the common liquid chamber 25, configures a space where ink common to plural pressure chambers 30 provided in a row in the pressure chamber formation substrate 29, described below, is stored. A housing space 17 is formed in the head case 16 at a position away from the liquid entry path 18. The pressure chamber formation substrate 29, the interposing substrate 33, the driving IC 34, and the like, are housed inside the housing space 17. As illustrated in FIG. 4, a wiring insertion port 19 that communicates with the housing space 17 is formed in the head case 16. A flexible substrate (not illustrated), which transmits drive signals and the like from a control circuit side of the printer 1 to the driving IC 34, is inserted into the wiring insertion port 19, and is connected to substrate wire portions 46 (wires of the invention) formed on the upper face of the interposing substrate 33 inside the housing space 17.

The communication substrate 24 of the present embodiment is plate member made from silicon. As illustrated in FIG. 3, the communication substrate 24 is formed with the common liquid chamber 25, which is in communication with the liquid entry path 18 and stores ink common to the pressure chambers 30, and plural individual communication ports 26 that individually supply ink inside the common liquid chamber 25 to respective pressure chambers 30. Nozzle communication ports 27 that penetrate the communication substrate 24 in the plate thickness direction are formed in the communication substrate 24 at positions corresponding to respective nozzles 22. Namely, plural nozzle communication ports 27 are formed along a nozzle row direction so as to correspond to the respective nozzles 22.

The nozzle plate 21 is a substrate made from silicon bonded to the lower face of the communication substrate 24 (the face on the opposite side to the pressure chamber formation substrate 29). In the present embodiment, openings at the lower face side of the space forming the common liquid chamber 25 are sealed off by the nozzle plate 21. Plural of the nozzles 22 are opened in straight line shapes (in a row) in the nozzle plate 21. The plural nozzles 22 provided in rows (nozzle rows) are provided uniformly spaced along the secondary scanning direction orthogonal to the primary scanning direction, with a pitch from one end side of the nozzles 22 to another end side of the nozzles 22 corresponding to a dot formation density.

The pressure chamber formation substrate 29 is made from a silicon substrate similarly to the communication substrate 24 and the nozzle plate 21. The pressure chamber formation substrate 29 is anisotropically etched so as to provide plural spaces for forming the pressure chambers 30 in a row along the nozzle row direction. These spaces are partitioned from below by the communication substrate 24 and are partitioned from above by the diaphragm 31, thereby configuring the pressure chambers 30. The pressure chambers 30 are formed elongated in a direction intersecting the nozzle row direction. One end portions in a longitudinal direction of the respective pressure chambers 30 are in communication with the individual communication ports 26, and the other end portions in the longitudinal direction of the respective pressure chambers 30 are in communication with the nozzle communication ports 27.

The diaphragm 31 is a thin film member with elastic properties, and is stacked on the upper face of the pressure chamber formation substrate 29 (the face on the opposite side to the communication substrate 24 side). The diaphragm 31 seals off upper openings of the spaces for forming the pressure chambers 30. In other words, upper faces (ceiling faces) of the pressure chambers 30 are partitioned by the diaphragm 31. Portions of the diaphragm 31 corresponding to the upper openings of the pressure chambers 30 function as displacement portions that are displaced along a direction moving away from, or a direction approaching, the nozzles 22 accompanying flexural deformation of the piezoelectric elements 32. Namely, regions of the diaphragm 31 corresponding to the upper openings of the pressure chambers 30 configure driving regions where flexural deformation is permitted. Deformation of the driving regions changes the capacity of the pressure chambers 30.

Note that the diaphragm 31 is, for example, configured from an elastic film composed of silicon dioxide ($SiO_2$) formed on the upper face of the pressure chamber formation substrate 29 and an insulating body layer composed of a zirconium oxide ($ZrO_2$) formed on the elastic film. The piezoelectric elements 32 are respectively stacked on regions corresponding to the respective pressure chambers 30 (namely, driving regions) on the insulating body layer (the face on the opposite side of the diaphragm 31 to the pressure chamber formation substrate 29 side). The piezoelectric elements 32 of the present embodiment are flexural mode piezoelectric elements. The respective piezoelectric elements 32 are, for example, formed by stacking a lower electrode layer, a piezoelectric body layer, and an upper electrode layer, on the diaphragm 31 in that sequence. In the piezoelectric elements 32 configured in this manner, when an electric field is applied between the lower electrode layer and the upper electrode layer according to a potential difference between the two electrodes, the piezoelectric elements 32 flexurally deform in a direction moving away from, or a direction approaching, the nozzles 22. As illustrated in FIG. 2, lead electrodes 37 extend from respective piezoelectric elements 32 toward the outside of the piezoelectric elements 32 (namely, to a non-driving region away from the driving regions). The lead electrodes 37 are wires for applying drive signals for driving the piezoelectric elements 32 to the piezoelectric elements 32, and are provided extending along a direction intersecting the nozzle row direction from the piezoelectric elements 32 to an end portion of the diaphragm 31.

The interposing substrate 33 of the present embodiment is configured from a crystalline substrate, specifically a monocrystalline silicon substrate, and is a member that functions as an interposer. Namely, the interposing substrate 33 is a substrate that electrically connects the driving IC 34, which is one type of a driving circuit, to the piezoelectric elements 32, which are one type of driving elements. Bonding resin 43 is interposed between the interposing substrate 33 and the diaphragm 31, and the interposing substrate 33 is disposed in a state forming a space that accommodates the piezoelectric elements 32. In the present embodiment, the surfaces, namely the upper face and the lower face of the interposing substrate 33 are made from (100) planes of monocrystalline silicon substrates. The driving IC 34, which outputs drive signals for driving of the piezoelectric elements 32, is disposed at the upper face side (corresponding to the first face of the invention, which is the face on the opposite side to the piezoelectric elements 32 side) of the interposing substrate 33. Drive signals, ejection data (raster data), and the like from the control circuit are input to the driving IC 34 through the flexible substrate (not illustrated), and the driving IC 34 controls the selection of drive pulses, from out of the drive signals, that are respectively output to the piezoelectric elements 32 based on the ejection data. Input terminals 42 to which drive signals, drive voltages, and the like from the flexible substrate are input, and output terminals 41 that are configured from a common terminal shared by the piezoelectric elements 32 and individual terminals provided so as to correspond to respective piezoelectric elements 32, are provided to the lower face (the face on the interposing substrate 33 side) of the driving IC 34.

As illustrated in FIG. 2, plural (four, in the present embodiment) of the input terminals 42 are provided in a row along an edge of the lower face of the driving IC 34 at one end in the nozzle row direction. Plural of the output terminals 41 are also provided in rows along the edges of the lower face of the driving IC 34 at each end in a direction intersecting the nozzle row direction, so as to correspond to the respective piezoelectric elements 32. The input terminals 42 and output terminals 41 are both formed of bump electrodes in which a conductive layer has been stacked on a portion of the surface of a resin portion formed from a synthetic resin. Namely, the input terminals 42 are each formed of a resilient body 42*a* formed projecting along the nozzle row direction, and a conductive layer 42*b* formed following the surface profile of the resilient body 42*a* so as to cross the resilient body 42*a*. The input terminals 42 are pressed against the substrate wire portions 46, described below, of the interposing substrate 33 to electrically connect to the substrate wire portions 46. Similarly, the output terminals 41 are each formed of a resilient body 41*a* formed projecting along the nozzle row direction, and a conductive layer 41*b* formed following the surface profile of the resilient body 41*a* so as to cross the resilient body 41*a*. The output terminals 41 are pressed against upper face side wires 38, described below, of the interposing substrate 33 to electrically connect to the upper face side wires 38.

The upper face side wires 38, electrically connected to the output terminals 41 of the driving IC 34 as described above, are formed on the upper face of the interposing substrate 33. Plural of the upper face side wires 38 are formed along the nozzle row direction so as to correspond to the respective piezoelectric elements 32. Other end portions of the upper face side wires 38, which have respective one end portions that are connected to the output terminals 41, are connected to lower face side wires 39 formed on the lower face of the interposing substrate 33 through penetrating wires 45. The penetrating wires 45 are wires relaying between the lower face and the upper face of the interposing substrate 33, and are configured from a conductor such as metal formed inside penetrating holes that penetrate the interposing substrate 33 in the plate thickness direction. Connecting electrodes 40 that are electrically connected to the lead electrodes 37 of the respective piezoelectric elements 32 are formed on the lower face (the face on the piezoelectric elements 32 side) of the interposing substrate 33. The connecting electrodes 40 and the penetrating wires 45 are connected through the lower face side wires 39. Similarly to the input terminals 42 and output terminals 41 of the driving IC 34, the connecting electrodes 40 of the present embodiment are each a type of bump electrode formed of a resin portion (a resilient body) and a conductive layer formed on the surface of the resin portion. The connecting electrodes 40 project toward the diaphragm 31 side of regions facing the lead electrodes 37. These connecting electrodes 40 are pressed against the lead electrodes 37 to establish electrical conduction with the lead electrodes 37. Note that a configuration may be adopted in which the connecting electrodes 40 are provided to the lead electrode 37 side of the diaphragm 31 (namely, with the lead electrodes 37 functioning as bump electrodes), and in which the connecting electrodes 40 and the lower face side wires 39 of the interposing substrate 33 are electrically connected.

The interposing substrate 33 and the pressure chamber formation substrate 29 (specifically, the pressure chamber formation substrate 29 onto which the diaphragm 31 has been stacked) are bonded to each other by the bonding resin 43 in a state in which the connecting electrodes 40 are interposed therebetween. In addition to functioning as an adhesive agent that bonds the interposing substrate 33 and the pressure chamber formation substrate 29 to each other, the bonding resin 43 functions as a spacer that forms a gap between the interposing substrate 33 and the pressure chamber formation substrate 29, the gap being to the extent that the driving of the piezoelectric elements 32 is not obstructed, and the bonding resin 43 functions as a sealing member that encloses the region where the piezoelectric elements 32 are formed such that the region is sealed off. Note that, for example, a thermosetting resin having an epoxy resin, an acrylic resin, a phenol resin, a polyimide resin, a silicone resin, a styrene resin, or the like as its primary component, and that includes a photopolymerization initiator or the like, may be suitably employed as the bonding resin 43.

In the recording head 3 formed as described above, ink from the ink cartridge 7 is introduced to the pressure chambers 30 through the liquid entry path 18, the common liquid chamber 25, and the individual communication ports 26. In this state, drive signals are selectively applied to the piezoelectric elements 32 from the output terminals 41 of the driving IC 34 through the penetrating wires 45 and other respective wires and the like, in accordance with discharge data input to the driving IC 34 from the flexible substrate through the substrate wire portions 46 and the input terminals 42. The piezoelectric elements 32 are thereby driven such that pressure fluctuations occur in the pressure chambers 30, and these pressure fluctuations are controlled to eject ink droplets from the nozzles 22.

Figure 5:
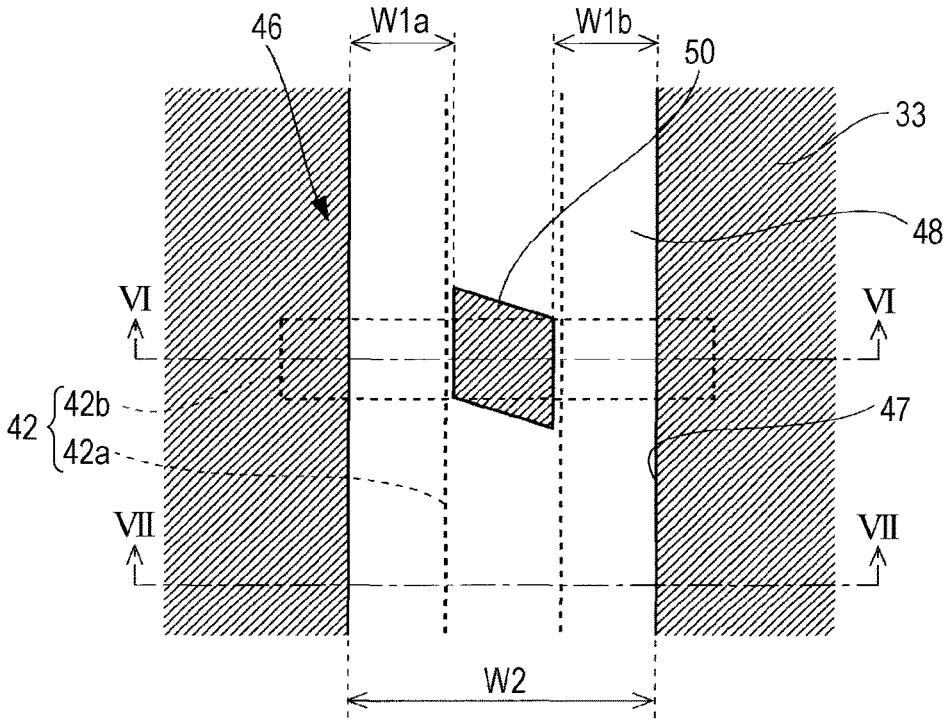
FIG. 5 is a plan view of a substrate wire portion.
Figure 6:
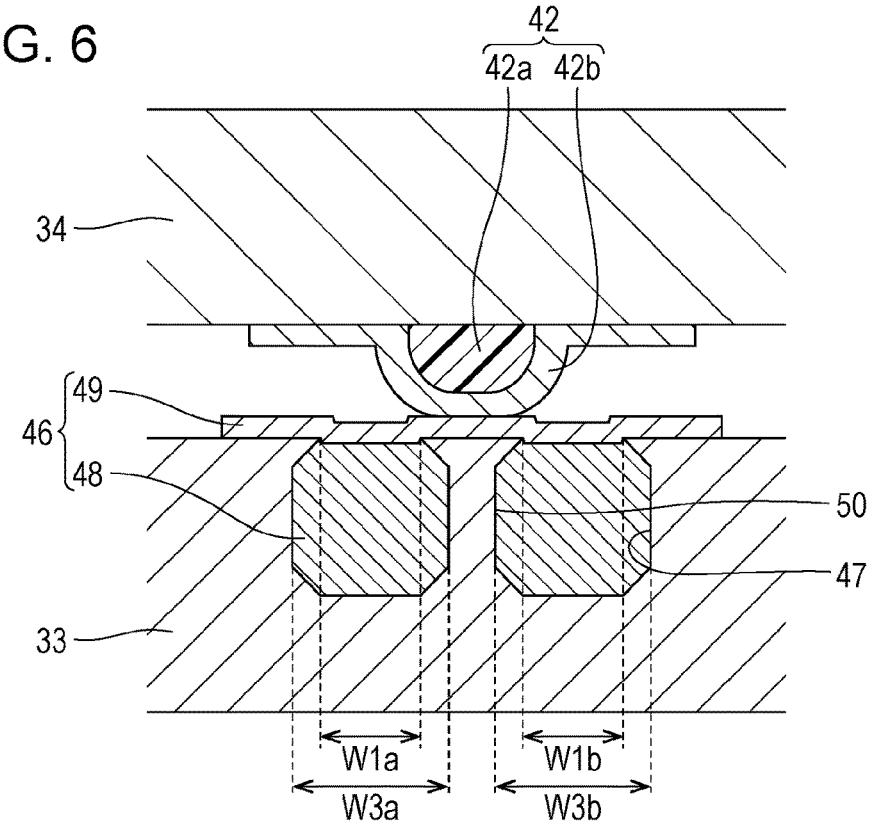
FIG. 6 is a cross-section taken along line VI-VI in FIG. 5.
Figure 7:
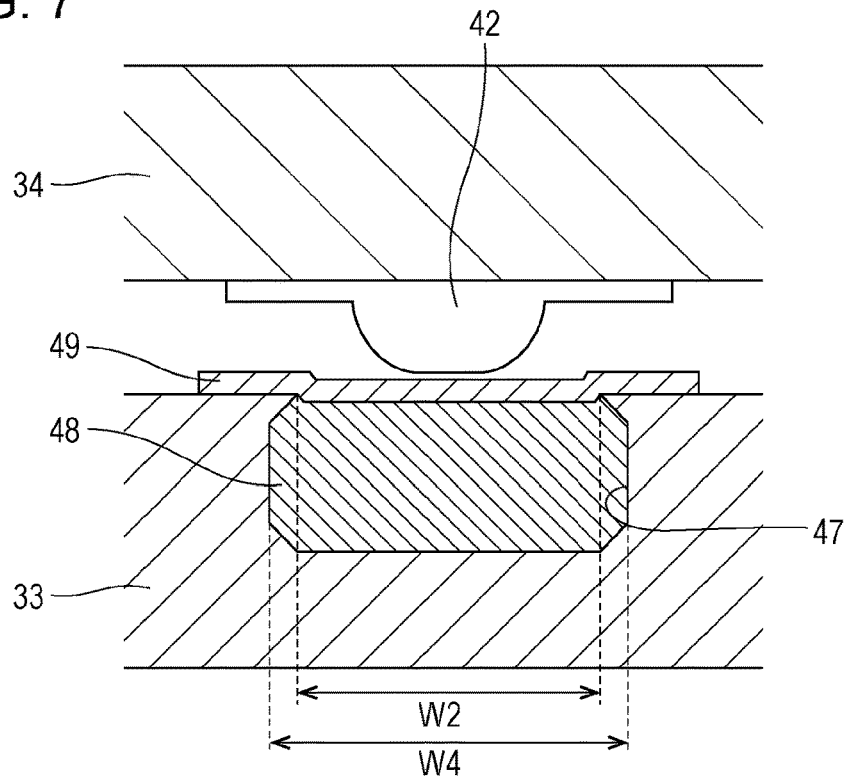
FIG. 7 is a cross-section taken along line VII-VII in FIG. 5.

FIG. 5 is a plan view illustrating configuration of the substrate wire portion 46 on the interposing substrate 33. FIG. 6 is a cross-section taken along line VI-VI in FIG. 5. FIG. 7 is a cross-section taken along line VII-VII in FIG. 5. Note that illustration of a conductive film 49 is omitted from FIG. 5. A substrate surface (upper face) of the interposing substrate 33 is illustrated by hatching in FIG. 5. The substrate wire portions 46 are formed on the upper face of the interposing substrate 33, electrically connected to the input terminals 42 of the driving IC 34, and electrically connected to the flexible substrate (not illustrated). Plural of the substrate wire portions 46 are provided in a row on the upper face of the interposing substrate 33, for each input terminal 42 of the driving IC 34. The conductive film 49, described below, is formed in a region where each substrate wire portion 46 is electrically connected to the respective input terminal 42 (a connection region). Herein, a connection region means a region where a substrate wire portion 46 (wire) and an input terminal 42 (bump electrode) are in contact, and in cases in which a width (a dimension in a second direction intersecting a first direction in which each substrate wire portion 46 extends) of the contact region is narrower than a width of the opening of a recess 47, the region is a connection region of a range encompassing the contact region and extends virtually along the second direction to the edges of the opening of the recess 47.

As illustrated in FIG. 4, plural groove-shaped recesses 47 (trenches) that extend along a direction (the first direction) intersecting the array direction (the second direction) of the substrate wire portions 46 are formed in strips in the upper face of the interposing substrate 33 so as to be separated by predetermined intervals along the terminal array direction. Etching processing (dry etching and wet etching) is performed on the monocrystalline silicon substrate that is the interposing substrate 33, as described below, to form the recesses 47. The recesses 47 are open at the upper face of the interposing substrate 33. A conductive portion 48 composed of a metal such as copper (Cu) or the like is filled into each recess 47 by plating or the like (namely, is embedded into the interposing substrate 33). Note that an insulating film (not illustrated) composed of a silicon oxide film or the like may be provided between each recess 47 and the respective conductive portion 48. Besides an insulating film, a diffusion prevention film or an adhesion film may also be provided.

A conductive film 49 composed of a conductive material such as gold (Au) or the like is deposited on the upper face of the interposing substrate 33 so as to cover the conductive portion 48 exposed at the opening of each recess 47 in the respective connection region. Each substrate wire portion 46 is formed of a respective conductive portion 48 and conductive film 49. The conductive film 49 is formed of stacking an adhesion layer 51 of titanium-tungsten (TiW), nickel-chromium (NiCr), or the like and a conductive layer 52 of gold (Au) or the like. The substrate wire portions 46 extend along a direction intersecting (orthogonal to) the terminal array direction on the upper face of the interposing substrate 33 from positions facing the input terminals 42 of the driving IC 34, through regions connected to wiring electrode terminals of the flexible substrate, to an end (edge) of the interposing substrate 33. Accordingly, the dimension (overall length) of each substrate wire portion 46 is sufficiently longer than the dimensions of the wiring electrode terminals of the flexible substrate and the input terminals 42 of the driving IC 34 along the direction intersecting the terminal array direction.

Each substrate wire portions 46 of the present embodiment is formed with a column shaped support portion 50 that supports the respective input terminal 42 at a position in the connection region with the input terminal 42. Namely, in plan view, the support portion 50 is provided inside the opening of the recess 47. The support portion 50 is a portion formed by causing silicon to remain, which is the base material of the interposing substrate 33, in a column shape when the recess 47 is formed by etching. In the present embodiment, the support portion 50 is not formed in a region outside of the connection region. Accordingly, in the connection region, the total width of the opening of the recess 47 in the second direction intersecting the first direction in which the substrate wire portion 46 extends, is narrower than the width of the opening of the recess 47 outside of the connection region. Herein, a total width means a dimension of the opening of the recess 47 along the second direction, and excludes the range of the support portion 50 inside the opening. Namely, as illustrated in FIG. 5 and FIG. 6, the total width W1 of the opening of the recess 47 in the connection region along the second direction (left-right direction in the figures) is the sum of widths W1*a* and W1*b* of the opening at both sides of the support portion 50. Providing the support portion 50 causes the total width W1 to be narrower than the total width W2 of the opening of the recess 47 outside the connection region by a corresponding amount.

By thus narrowing the width of the opening of the recess 47 in the connection region, after the conductive portion 48 is filled into the recess 47 by plating or the like as described below, so-called dishing, in which the conductive portion 48 sinks below the surface of the interposing substrate 33 during a polishing process, can be suppressed. Accordingly, a step between the surface (upper face) of the interposing substrate 33 and the conductive portion 48 inside the opening of the recess 47 can be suppressed, and thus the risk of the conductive film 49 disconnecting at the step can be reduced. Accordingly, it is also possible to suppress an increase in resistance or the occurrence of migration or the like due to the step. Further, in the connection regions, variation in the height (the position in the stacking direction of the substrates) of the substrate wire portions 46 becomes less likely to occur, which enables reduction of the load needed to establish electrical conduction when the input terminals 42 composed of bump electrodes are pressed against the substrate wire portion 46 to make electrical connection therewith. Variation in the height of the substrate wire portions 46 is not limited to variation in the heights between substrate wire portions 46. Variation can also be suppressed between the substrate wire portions 46 and other wire portions on the interposing substrate 33. Accordingly, when respective substrates are stacked and load is applied in a direction for both substrates to mutually approach each other such that respective wires on both substrates are connected by the bump electrodes, it is possible to suppress disadvantages due to excessive load such as the electrode layers of the bump electrodes disconnecting, the substrates breaking, or the like. Additionally, in the present embodiment, when the input terminals 42 and the substrate wire portions 46 are connected, the input terminals 42 are supported by the support portions 50 composed of the base material of the interposing substrate 33, which enables electrical conduction to be reliably ensured while reducing the aforementioned load. Adopting such a configuration enables a more reliable recording head 3 (MEMS device) and printer 1 to be provided.

Narrowing the width of the opening of each recess 47 in the connection region (narrowing the opening surface area) causes a corresponding increase in an electrical resistance component. In the present embodiment, to suppress this, as illustrated in FIG. 6, the total width W1 (W1*a*+W1*b*) along the second direction of the opening of each recess 47 in the connection region is narrower than the total width W3 (W3*a*+W3*b*) inside (partway along the thickness direction of the interposing substrate 33) the recess 47 in the connection region. In other words, the total width W3 inside each recess 47 in the connection region is wider than the total width W1 of the opening of the recess 47 in the connection region. Similarly, as illustrated in FIG. 7, the total width W4 inside each recess 47 in a region outside of the connection region is wider than the total width W2 of the opening of the recess 47 in this region. By making the widths inside each recess 47 wider than the widths of the openings of the recess 47, even though the width of the openings of each recess 47 on the substrate surface is narrowed, the cross-sectional area of the respective substrate wire portion 46 can be increased, which enables an increase in electrical resistance due to narrowing the width of the opening of each recess 47 in the connection region to be suppressed.

Figure 8:
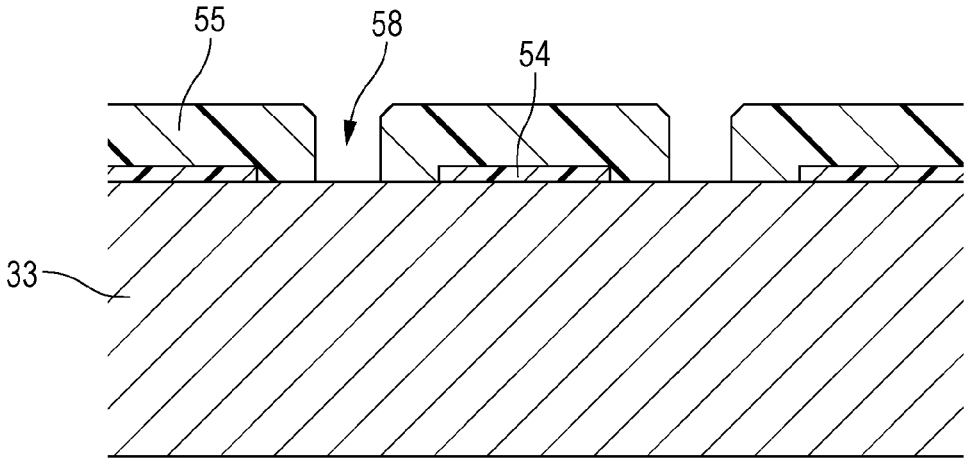
FIG. 8 is a process diagram describing a substrate wire portion manufacturing process.

FIG. 8 to FIG. 13 are process diagrams describing a process for forming each substrate wire portion 46 on the interposing substrate 33, and illustrate a cross-section at a position in the connection region. First, as illustrated in FIG. 8, a first mask 54 and a second mask 55 are formed on a face that will become a mounting face (first face) of a monocrystalline silicon substrate that is the material of the interposing substrate 33 (a mask forming process). These masks may be, for example, a resist or the like composed of a silicon oxide film, a silicon nitride film, or a photosensitive resin, so long as they function as masks in a dry etching process and a wet etching process explained below. Mask openings 57 are formed in the first mask 54 by exposure and developing (see FIG. 9). The mask openings 57 are openings employed in a wet etching process. Similarly, mask openings 58 are formed in the second mask 55 (see FIG. 8). The mask openings 58 are openings employed in a dry etching process. Since the support portions 50 are provided at portions in the connection region in the present embodiment, the portions corresponding to the support portions 50 are masked. Note that the opening surface area of the mask openings 58 is set smaller than the opening surface area of the mask openings 57.

Figure 9:
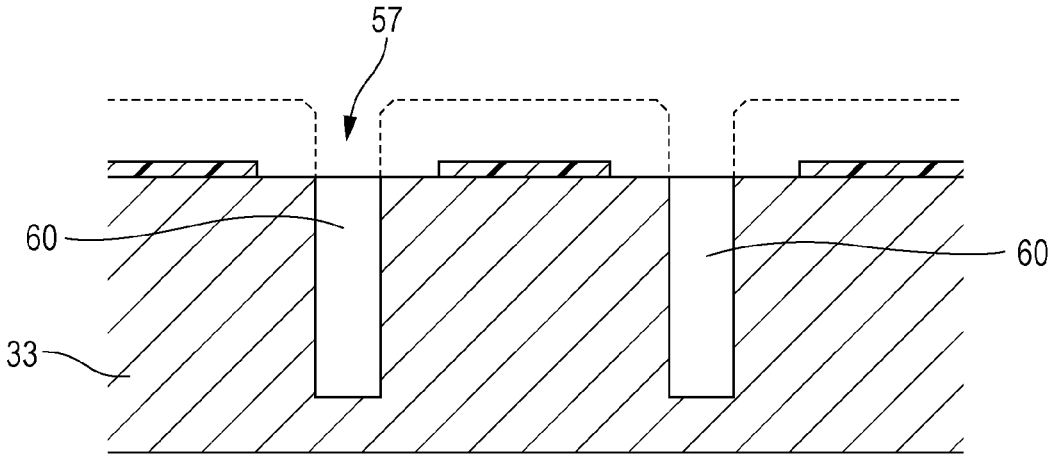
FIG. 9 is a process diagram describing a substrate wire portion manufacturing process.

Next, as illustrated in FIG. 9, a dry etching process is performed through the mask openings 58 of the second mask 55, and cavities 60, which are portions from which formation of the recesses 47 will originate, are formed at positions where the recess 47 is intended to be formed. The cavities 60, for example, are formed partially in the thickness direction of the base material of the interposing substrate 33 by an etching process such as the Bosch process. Namely, a plasma etching process and a process of forming a protective film on inner peripheral walls of holes are sequentially repeated to form the cavities (vertical holes) 60 extending along the thickness direction of the interposing substrate 33. The cavities 60 are respectively formed at both sides of the region where the support portion 50 is intended to be formed in the connection region. In regions where the recesses 47 outside of the connection region are intended to be formed, the cavities 60 are set wider than the cavities 60 in the connection region. The cross-sectional area of each cavity 60 along an orientation parallel to the orientation of the upper and lower faces of the base material of the interposing substrate 33 is smaller than the cross-sectional area (the cross-sectional area at completion) of the later-formed recess 47, and in the present embodiment, is adjusted so as to be smaller than the opening surface area (opening surface area at completion) of the recess 47 in the upper face of the base material. The depth of each cavity 60 is adjusted to the depth needed for the recess 47. Note that the method of forming the cavities 60 is not limited to the example illustrated, and although various procedures, such as a method employing a laser, may be adopted, it is preferable that the depth of the cavities 60 is able to be desirably adjusted. After forming the cavities 60, the second mask 55 is removed.

Figure 10:
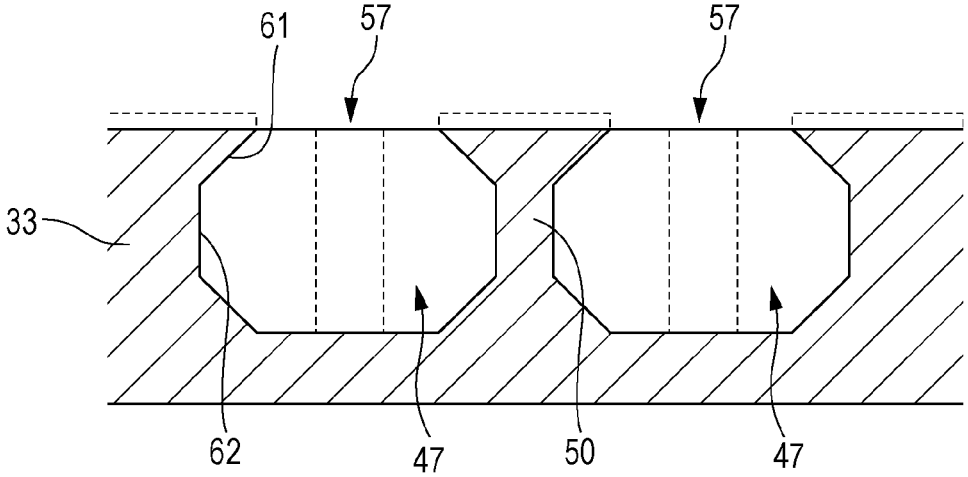
FIG. 10 is a process diagram describing a substrate wire portion manufacturing process.

When the cavities 60 have been formed, next, a wet etching process is performed by introducing an etching solution composed of potassium hydroxide (KOH) through the mask openings 57 of the first mask 54. In the present embodiment, the etching rate of a (110) plane orthogonal to a (100) plane that is parallel to the substrate surface of the interposing substrate 33 is faster than the etching rate of a (111) plane. Thus, as illustrated in FIG. 10, as the wet etching process progresses, the cavities 60 expand toward the sides (in a direction intersecting the plate thickness direction of the interposing substrate 33), and both inclined faces 61 formed of (111) planes inclined approximately 55° with respect to a (100) plane that is parallel to the substrate surface of the interposing substrate 33, and side faces 62 formed of (110) planes orthogonal to the (100) plane, are formed. Recesses 47 having a wider internal total width than a total width of openings in the substrate surface of the interposing substrate 33 are thereby formed. In the present embodiment, the wet etching process is completed when a support portion 50 of a desired shape and size has been formed at the position corresponding to the connection region. In the present embodiment, although the side faces 62 remain when the wet etching process has been completed, depending on the shape and size of the planned recess 47, the wet etching process may be performed until the side faces 62 have disappeared. After forming the recess 47, the first mask 54 is removed. Note that although an example has been given in the present embodiment of configuration in which the upper and lower faces of the interposing substrate 33 are (100) planes, even when, for example, the upper and lower faces of the interposing substrate 33 are (110) planes, by performing a process similar to the above, recesses can be formed that have a wider internal total width than a total width of openings in the substrate surface of the interposing substrate 33. However, in such a case, the angle of the inclined faces with respect to the substrate surface of the interposing substrate 33 differs (60°).

Figure 11:
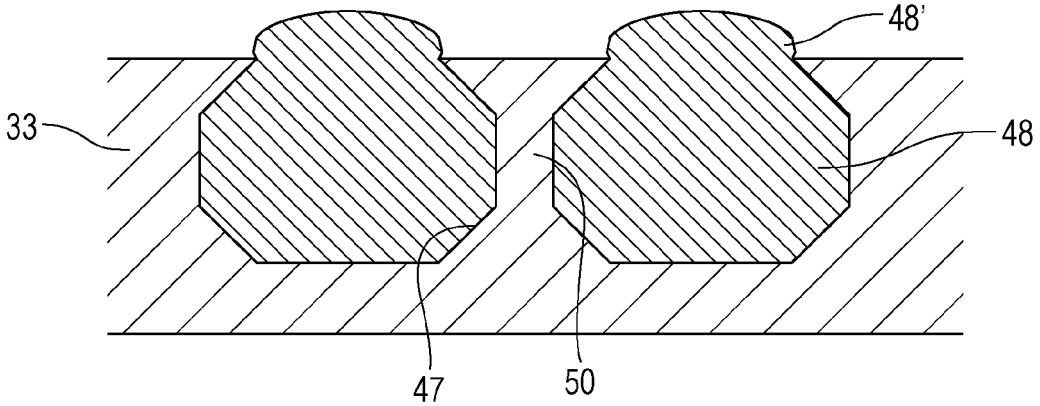
FIG. 11 is a process diagram describing a substrate wire portion manufacturing process.
Figure 12:
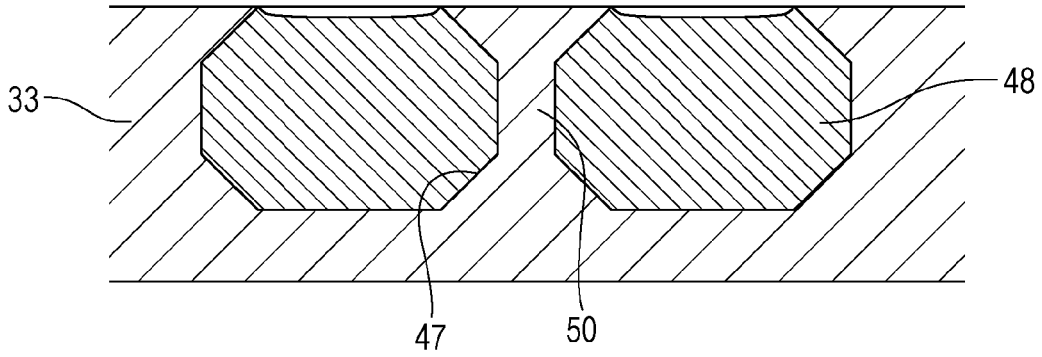
FIG. 12 is a process diagram describing a substrate wire portion manufacturing process.

When the wet etching process has been completed, then, as illustrated in FIG. 11, a conductive material such as copper (Cu) or the like is filled into the recesses 47 by a plating process to form the conductive portion 48. When this is performed, a bulge portion 48' is formed where the conductive material rises out from the opening of each recess 47. Accordingly, after forming the conductive portion 48, a polishing process is performed to remove the excess bulge portions 48'. Namely, the upper face of the interposing substrate 33 where the bulge portions 48' are formed is polished using CMP. As illustrated in FIG. 12, the upper face of the interposing substrate 33 is mostly planarized. When this is performed, since the total width of the openings of each recess 47 in the connection region is formed so as to be narrower than the opening width of the recess 47 outside the connection region, dishing in which the conductive portion 48 sinks below the surface of the interposing substrate 33 due to excessive planarizing of the conductive portion 48, which is softer than the base material (silicon) of the interposing substrate 33, is suppressed in at least the connection region. Additionally outside the connection region, by causing the width inside each recess 47 to be wider than the width of the opening of the recess 47, the width of the opening of the recess 47 in this region can be narrowed without inviting an increase in electrical resistance, which enables dishing to be suppressed.

Figure 13:
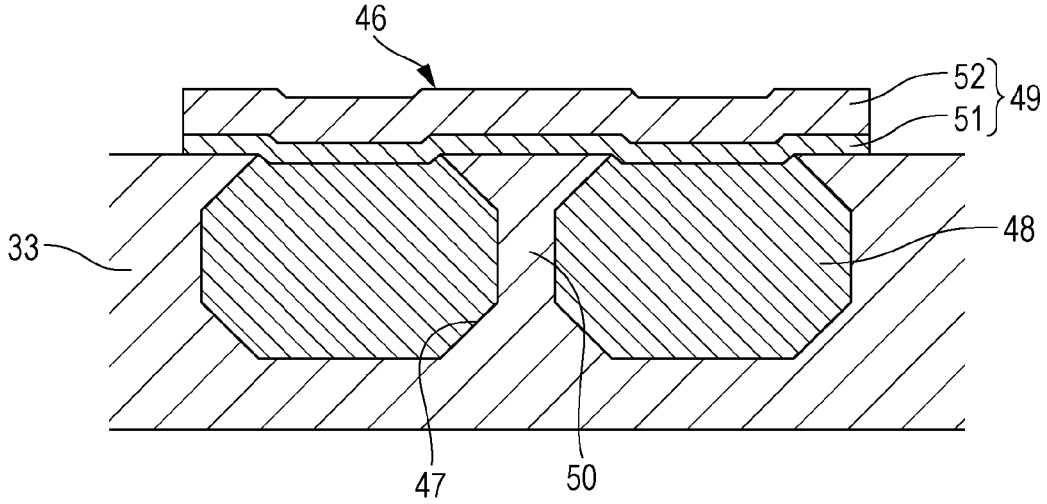
FIG. 13 is a process diagram describing a MEMS device manufacturing process.

Then, as illustrated in FIG. 13, a conductive film 49 is formed at a position where each connection region will be formed, so as to cover the surfaces of the conductive portion 48 exposed at the openings of the recess 47 and the surface of the support portion 50. In this process, an adhesion layer 51 is deposited, and then a conductive layer 52 is deposited in a configuration stacked over the adhesion layer 51. In the present embodiment, the adhesion layer 51 is, for example, made from titanium-tungsten (TiW) and the conductive layer 52 is, for example, made from gold (Au). A sputtering process, CVD process, plating process, or the like may be adopted as the deposition method. Then, the adhesion layer 51 and the conductive layer 52 are patterned using a photolithographic technique and the conductive film 49 is formed. Through the above processes, the substrate wire portions 46 are formed on the mounting face of the interposing substrate 33.

Figure 14:
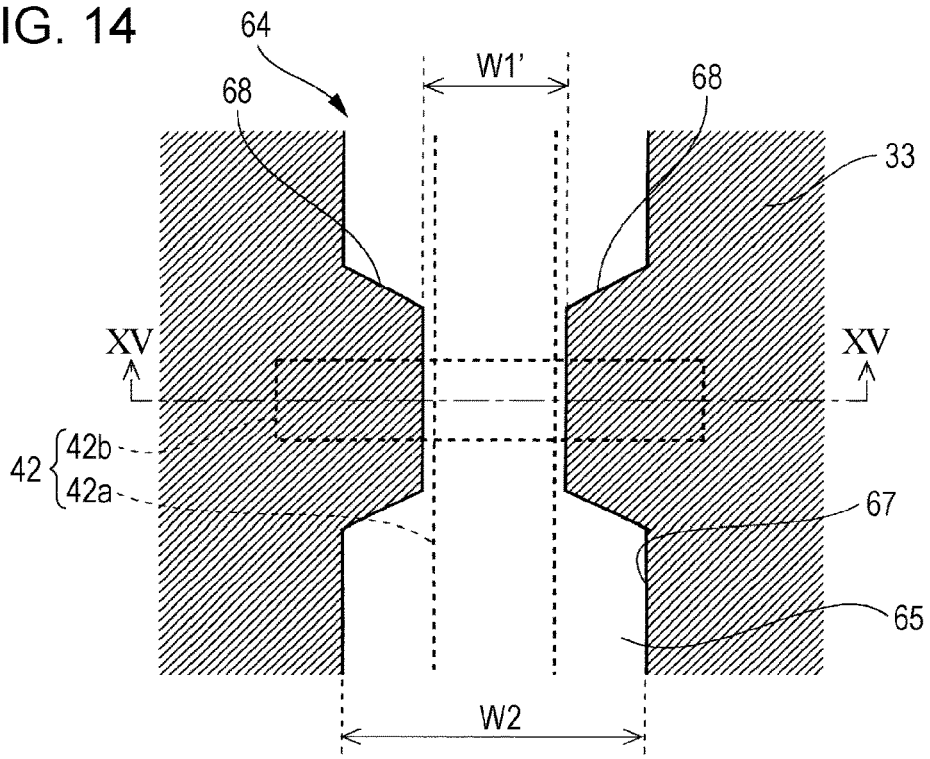
FIG. 14 is a plan view of a substrate wire portion of a second embodiment.
Figure 15:
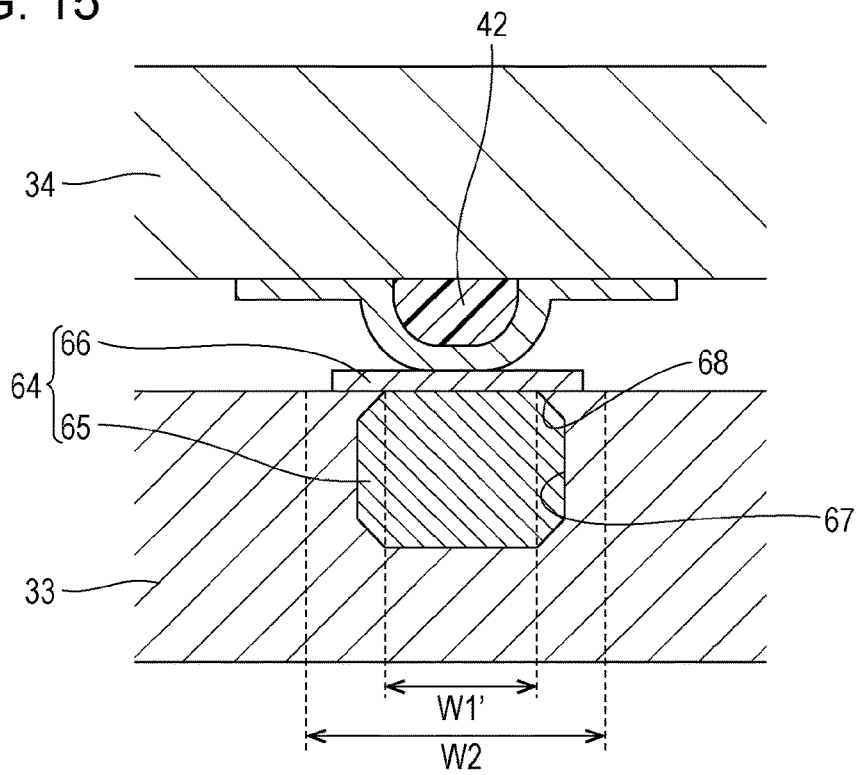
FIG. 15 is a cross-section taken along line XV-XV in FIG. 14.

FIG. 14 and FIG. 15 are diagrams illustrating configuration of a substrate wire portion 64 of a second embodiment of the invention. FIG. 14 is a plan view, and FIG. 15 is a cross-section taken along line XV-XV in FIG. 14. Although an example was given in which the substrate wire portion 46 in the first embodiment above has a configuration in which the opening of the recess 47 is provided with an island shaped support portion 50, there is no limitation thereto. The substrate wire portion 64 of the present embodiment differs from the first embodiment in that, in the connection region with the input terminals 42, edges of the opening of a recess 67 respectively project further in the second direction toward the opposing opening edge side than edges of the opening in a region outside the connection region, so as to form projections 68. By providing the projections 68 at a portion corresponding to the connection region of the substrate wire portion 64 in this manner, the width of the opening of each recess 67 along the second direction in the connection region becomes narrower than the width of the opening of the recess 67 in a region outside the connection region. Namely, the opening width (total width of the opening) W1' of the recess 67 along the second direction (the left-right direction in the figures) in the connection region is narrower than the opening width W2 of the recess 67 outside the connection region by an amount corresponding to the provision of the projections 68 to both sides of the recess 67. Thus, by causing the opening width of the recess 67 in the connection region to be narrower than the opening width of the recess 67 outside the connection region, similarly to in the first embodiment above, during a polishing process after a conductive portion 65 has been filled into the recess 67 by plating or the like, dishing, in which the conductive portion 65 sinks below the surface of the interposing substrate 33 due to the conductive portion 65 being excessively planed, is suppressed. Additionally, similarly to the support portion 50 of the first embodiment above, the projections 68 bear load during connection with the input terminals 42, which enables electrical conduction to be more reliably ensured.

In each of the above embodiments, explanation was given using an example in which the electrical connection between a bump electrode and a connection region of a wire is a connection between a substrate wire portion 46, which is one type of wire on the interposing substrate 33, and an input terminal 42, which is one type of bump electrode on the driving IC 34, which is one type of driving circuit, (the electrical connection between the bump electrode and the connection region of a wire is a connection between a driving circuit and a substrate); however, there is no limitation thereto. For example, the invention may be applied to a connection between a lead electrode 37 of a piezoelectric element 32, which is one type of driving element, and a lower face side wire 39 of the interposing substrate 33. In such a case, configuration may be made in which a bump electrode is provided to each lead electrode 37, and the lower face side wires 39 are wires having similar structure to that of the substrate wire portions 46. Namely, in this structure, the electrical connection between the bump electrodes and the connection regions of the wires is a connection between a substrate and a driving element. In this configuration, dishing of the lower face side wires 39 is also suppressed, thereby enabling more reliable electrical conduction to be ensured between the lead electrodes 37 and the lower face side wires 39. As a result, since a more reliable electrical connection can be ensured between the driving circuit and the driving element, the reliability of the MEMS device can be improved.

Moreover, the invention can be applied to configurations not including an interposing substrate 33. Namely, the invention can be applied to a portion electrically connecting a driving element and a driving circuit in a configuration in which the driving circuit is stacked on a substrate provided with the driving element.

Moreover, there is no limitation to the shape or the size of the support portion 50 and the projections 68 given as examples in the above embodiments. For example, each support portion 50 may be an elongated island shape extending along the extension direction of the respective substrate wire portion 46 (the first direction). As illustrated in FIG. 14, the projections 68 are also not limited to being substantially trapezoidal shaped in plan view, and may be any shape that reduces the opening width of the recess 47 in the substrate wire portion 46.

Moreover, the invention can be applied to any MEMS devices in which the electrode terminals of plural substrates are electrically connected to each other. For example, the invention can be applied to MEMS devices such as sensors that detect pressure changes, vibration, displacement, or the like in movable regions.

In the above embodiments, although explanation has been given regarding an example in which an ink jet recording head 3 serves a liquid ejecting head, the invention can be applied to other liquid ejecting heads in which the electrode terminals of plural substrates are electrically connected to each other. For example, the invention can be applied to colorant ejecting heads employed in the manufacture of color filters for liquid crystal displays or the like, electrode material ejecting heads employed to form electrodes of organic electroluminescent (EL) displays, field emission displays (FEDs), or the like, bioorganic matter ejecting heads employed in the manufacture of biochips (biochemical elements), and the like. In colorant ejecting heads for display manufacturing apparatuses, solutions of R (red), G (green), and B (blue) colorants are each ejected as respective types of liquid. In electrode material ejecting heads for electrode forming apparatuses, a liquid electrode material is ejected as one type of liquid, and in bioorganic matter ejecting heads for chip manufacturing apparatuses, a bioorganic matter solution is ejected as one type of liquid.

What is claimed is:

1. A MEMS device comprising:

a wire that is formed of a conductive portion embedded into a recess opened in a first face of a substrate and a film member that is disposed over an opening of the recess in the first face; and a bump electrode that is electrically connected to the wire, wherein a total width, in a second direction intersecting a first direction along which the wire extends on the first face, of an opening of the recess in a connection region where the wire and the bump electrode are electrically connected to each other is narrower than a width, in the second direction, of an opening of the recess in a region outside the connection region.

2. The MEMS device according to claim 1, wherein the wire includes a support portion that supports the bump electrode in the opening of the recess in the connection region.

3. A liquid ejecting head comprising:

the MEMS device according to claim 2.

4. A liquid ejecting apparatus comprising:

the liquid ejecting head according to claim 3.

5. The MEMS device according to claim 1, wherein an edge of the opening of the recess in the connection region projects further in the second direction toward an opposing opening edge side than an edge of the opening in the region outside the connection region.

6. A liquid ejecting head comprising:

the MEMS device according to claim 5.

7. A liquid ejecting apparatus comprising:

the liquid ejecting head according to claim 6.

8. The MEMS device according to claim 1, wherein a total width, in the second direction, of the opening of the recess in the connection region is narrower than a total width, in the second direction, inside the recess in the connection region.

9. A liquid ejecting head comprising:

the MEMS device according to claim 8.

10. A liquid ejecting apparatus comprising:

the liquid ejecting head according to claim 9.

11. The MEMS device according to claim 1, wherein the bump electrode is formed of a resilient body composed of resin with a conductive layer formed on a surface of the resilient body.

12. A liquid ejecting head comprising:

the MEMS device according to claim 11.

13. A liquid ejecting apparatus comprising:

the liquid ejecting head according to claim 12.

14. The MEMS device according to claim 1, wherein:

the substrate electrically connects, through the wire, a driving circuit and a driving element driven by signals output from the driving circuit, and the electrical connection between the bump electrode and the connection region is a connection between the driving circuit and the substrate or a connection between the substrate and the driving element.

15. A liquid ejecting head comprising:

the MEMS device according to claim 14.

16. A liquid ejecting apparatus comprising:

the liquid ejecting head according to claim 15.

17. A liquid ejecting head comprising:

the MEMS device according to claim 1.

18. A liquid ejecting apparatus comprising:

the liquid ejecting head according to claim 17.

* * * * *